US005517963A

United States Patent [19]

Yoshida et al.

[11] Patent Number: 5,517,963

[45] Date of Patent: May 21, 1996

[54] CHARGE FORMER LINKAGE SYSTEM FOR OUTBOARD MOTOR

[75] Inventors: Sadato Yoshida; Hiroshi Nakai; Akihiko Hoshiba; Yasuhiko Shibata, all of Hamamatsu, Japan

[73] Assignee: Sanshin Kogyo Kabushiki Kaisha, Shizuoka, Japan

[21] Appl. No.: 302,627

[22] Filed: Sep. 8, 1994

[30] Foreign Application Priority Data

Sep. 8, 1993 [JP] Japan ..... 5-246094

[51] Int. Cl.[6] ..... F02B 13/00; F02D 9/02

[52] U.S. Cl. ..... 123/336; 123/583

[58] Field of Search ..... 123/583, 336, 123/579, 580, 196 W

[56] References Cited

U.S. PATENT DOCUMENTS

| | | | |
|---|---|---|---|
| 3,030,819 | 4/1962 | Edelbrock | 123/579 |
| 3,035,601 | 5/1962 | Moseley | 123/579 |
| 4,632,082 | 12/1986 | Hattori et al. | 123/336 |
| 4,971,006 | 11/1990 | Imaeda | 123/583 |
| 4,995,370 | 2/1991 | Imaeda | 123/583 |
| 5,326,293 | 7/1994 | Shishido et al. | 123/580 |

FOREIGN PATENT DOCUMENTS 2-119947 9/1990 Japan .

*Primary Examiner*—Erick R. Solis

*Attorney, Agent, or Firm*—Knobbe, Martens, Olson & Bear

[57] ABSTRACT

A linkage system interconnects a plurality of throttle shafts, while minimizing the effects of thermal expansion in the linkage on the throttle shafts. The linkage includes a plurality of linkage rods which interconnect a plurality of throttle levers attached to the throttle shafts. At least a first and a second linkage rod are connected to a first lever in a manner in which thermal expansion of the first linkage rod applies a force to the first lever which is equal but opposite to a force applied to the first lever due to thermal expansion of the second linkage rod.

20 Claims, 2 Drawing Sheets

CHARGE FORMER LINKAGE SYSTEM FOR OUTBOARD MOTOR

BACKGROUND OF THE INVENTION

1. Field of the Invention

The present system related in general to an engine for an outboard drive, and more particularly to a linkage system between charge formers of a marine engine.

2. Description of Related Art

A conventional internal combustion engine, which power an outboard drive, typically includes a plurality of charge formers to produce a fuel charge which is delivered to the combustion chambers of the engine. A throttle linkage commonly interconnects the charge formers to synchronize the operation of the charge formers and thus stabilize engine revolution. Other linkages, such as, for example, a choke linkage, may also interconnect other components (e.g., choke shafts) of the charge formers to synchronize the operation of those components.

Prior linkage designs for charge formers currently include a series of linkage rods which operate a plurality of levers. In the case of a throttle linkage, one end of a throttle lever is connected to a series of linkage rods and the other end is connected to a throttle shaft which operates a throttle valve. The throttle linkage typically includes a plurality of such levers which are placed in parallel to one another. The series of linkage rods operates the levers to control the positions of the throttle shaft.

With increased temperature, prior throttle linkage designs thermally expand which cause the positions of the throttle shafts and the corresponding throttle valves to become unsynchronized. For instance, where a linkage rod connects to a relatively fixed first throttle lever at one end and a movable second throttle lever at the other end, thermal expansion of the linkage rod will move the second lever relative to the first lever. The second lever therefore will no longer lie parallel to the first lever, and consequently the corresponding angle of the second throttle valve, which is operated by the second throttle lever, will differ from the angle of the first throttle valve. Thermal expansion of the linkage rod thus unsynchronizes the operation of the first and second throttle valves.

The prior arrangement of the linkage rods in a collinear series compounds this problem. The increased length of each throttle rod stacks up so that the lever operating the last throttle valve typically moves by an amount corresponding to the combined length increases of each throttle rod within the series. The angles of the first and last throttle valves thus can greatly differ so that the operation of the charge formers are no longer synchronized and engine revolution becomes unstabilized. When this occurs at a low revolutional speed (i.e., under idling conditions) the engine can stall.

SUMMARY OF THE INVENTION

A need therefore exists for a linkage system between a plurality of charge formers to synchronize the operation of the charger formers, while minimize the effects of thermal expansion in the linkage system on the operation of the charge formers.

In accordance with an aspect of the present invention, a linkage system interconnects a plurality of charge formers in an engine to synchronize the operation of the charge formers. The linkage system specifically interconnects a plurality of operators of the charge formers. The linkage system includes a plurality of linkage rods which interconnect adjacent operators. The plurality of linkage rods includes at least a first and a second linkage rod which connect to a first operator in a manner in which thermal expansion of the first linkage rod forces the first operator in a direction generally opposite to a direction in which thermal expansion of the second linkage rod forces the first operator.

In accordance with another aspect of the present invention, a linkage system interconnects a plurality of throttle devices in an engine to synchronize the operation of the throttle devices. Throttle devices include throttle shafts which operate throttle valves. The linkage system includes a plurality of levers. Each lever is attached to an individual throttle shaft. A plurality of linkage rods interconnect adjacent pairings of the levers. The plurality of linkage rods includes at least a first and a second linkage rod which are connected to a first lever of a plurality of levers. The first and second linkage rods connect to the first lever in a manner in which thermal expansion of the first linkage rod applies a force to the first lever which is equal but opposite to a force applied to the first lever due to thermal expansion of the second linkage rod.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF A PREFERRED EMBODIMENT

Figure 1:
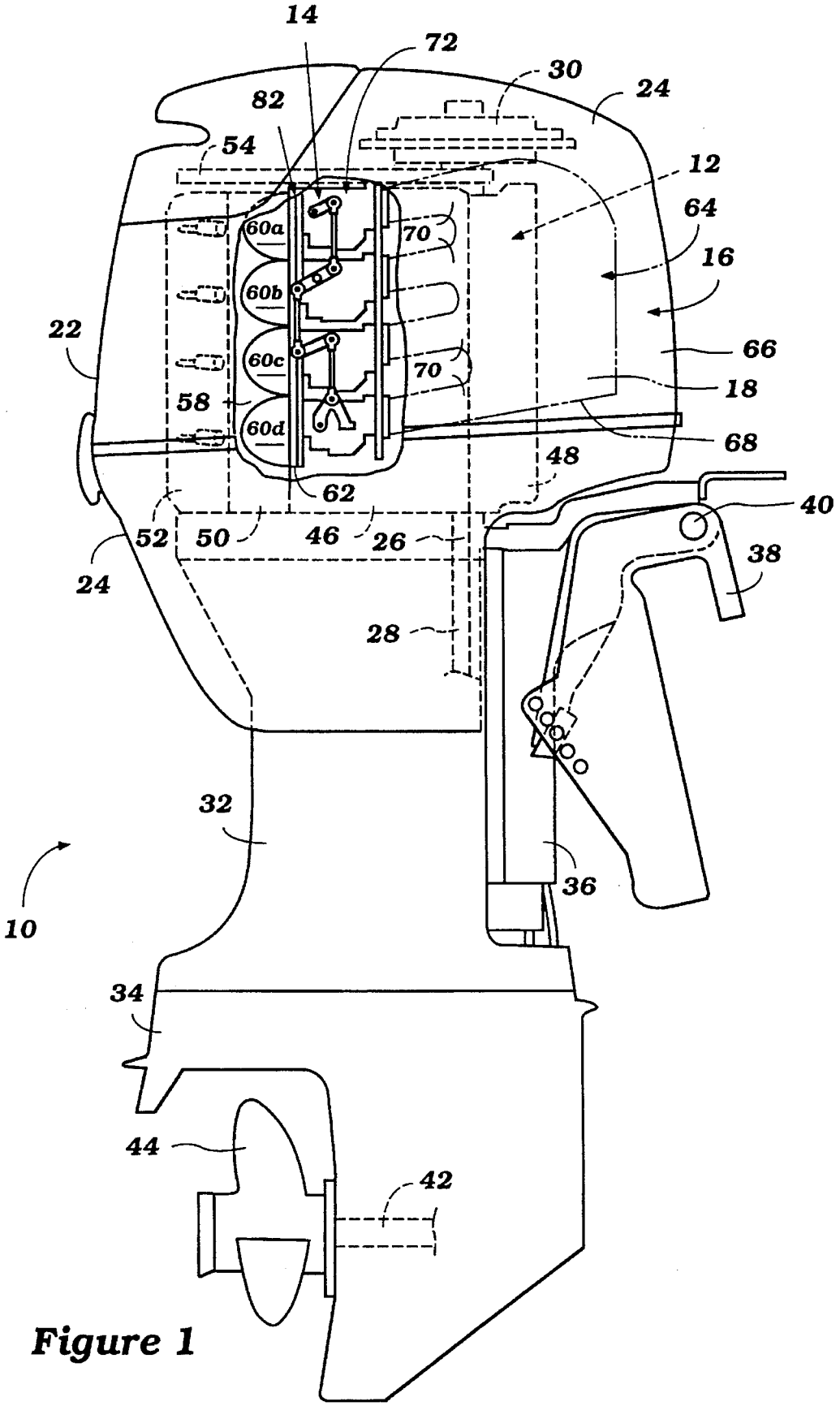
FIG. 1 is a partial cut-away, side elevational view of a marine outboard motor in accordance with a preferred embodiment of the present invention.

FIG. 1 illustrates a marine outboard drive 10 having an internal combustion engine 12 which incorporates a charge former linkage system 14 configured in accordance with a preferred embodiment of the present invention. Though it is understood that the present throttle system can be incorporated into any type of engine, the present invention is particularly well suit with a vertically oriented engine of a marine outboard motor. It is contemplated, however, that certain aspects of the invention can be employed with an inboard/outboard motor equally as well.

In the illustrated embodiment, the outboard drive 10 has a power head 16 formed in part by the engine 12. The engine 12 desirably is a four-stroke, in-line, four-cylinder combustion engine. It will be readily apparent to those skilled in the art, however, that the present charge former linkage system 14 may be employed with engines having other number of cylinders, having other cylinder orientations, and/or operating on other than a four-stroke principal.

A protective cowling 18 of a known type surrounds the engine 12. The cowling 18 desirably includes a lower tray 20 and a top cowling member 22. These components 20, 22 of the protective cowling 18 together define an engine compartment 24 which houses the engine 16.

As seen in FIG. 1, the engine 16 is mounted conventionally with its output shaft 26 (i.e., crankshaft) rotating about a generally vertical axis. The crankshaft 26 is suitably journaled within the engine 12 and drives a drive shaft 28. The drive shaft 28 depends from the power head 16 of the outboard drive 10. A standard magneto generator/flywheel assembly 30 is attached to the upper end of the crankshaft 24.

As seen in FIG. 1, a drive shaft housing 32 extends downward from the lower tray 20 and terminates in a lower unit 34. A steering bracket 36 is attached to the drive shaft housing 32 in a known matter. The steering bracket 36 also is pivotably connected to a clamping bracket 38 by a pin 40. The clamping bracket 38, in turn, is configured to attach to a transom of the watercraft (not shown). This conventional coupling permits the outboard drive 10 to be pivoted relative to the steering bracket 36 for steering purposes, as well as to be pivoted relative to the pin 40 to permit adjustment to the trim position of the outboard drive 10 and for tilt up of the outboard drive 10.

Although not illustrated, it is understood that a conventional hydraulic tilt and trim cylinder assembly, as well as a conventional hydraulic steering cylinder assembly could be used as well with the present outboard drive. It is also understood that the above description of the construction of the outboard drive is conventional, and, thus, further details of the steering, trim, and mounting assemblies are not necessary for an understanding of the present invention.

As schematically illustrated in FIG. 1, the drive shaft 28 extends through and is journaled within the drive shaft housing 32. A transmission (not shown) selectively couples the drive shaft 28 to a propulsion shaft 42. The transmission desirably is a forward/neutral/reverse-type transmission to selectively drive the propulsion shaft 42 in a reverse or forward direction.

The propulsion shaft 42 drives a propulsion device 44, such as, for example, a propeller, a hydrodynamic jet, or the like. In the illustrated embodiment, the propulsion device 44 is a single propeller; however, it is understood that a counter-rotational propeller device can be used as well.

With reference back to the engine 12 illustrated in FIG. 1, the engine 12 includes a cylinder block 46 which desirably defines four cylinder bores (not shown) that have their axes lying on different horizontal planes, yet lying within a common vertical plane. Pistons (not shown) reciprocate within the cylinder bores, and connecting rods (not shown) link the pistons and the crankshaft 26 together so that the reciprocal linear movement of the pistons rotates the crankshaft 26 in a known manner. A crankcase 48, attached to the cylinder block 46 by known means, surrounds at least a portion of the crankshaft 26 with the crankshaft 26 journaled therein.

On the opposite end of the cylinder block 46, a cylinder head 50 is attached. The cylinder head 50 has a conventional construction, and supports and houses an intake and exhaust valve system (not shown).

A cam cover 52 is attached to the cylinder head 50, on a side of the cylinder head opposite the cylinder block 46. The cam cover 52 and the cylinder head 50 together define a cam chamber in which a conventional valve operation mechanism is journaled. In the illustrated embodiment, the engine 12 includes an overhead camshaft (not shown) which operates the overhead intake and exhaust valve system. The crankshaft 26 drives the overhead camshaft via an external tooth timing belt 54. Because the invention deals primarily with the charge former linkage system 14 of the induction system of the engine 12, it is not believed necessary to discuss or describe in greater detail the particular valve system and valve operation mechanism of the engine 12.

As seen in FIG. 1, the cylinder head 50 includes an integral intake manifold 58 having a plurality of intake pipes 60. For ease of description, each intake pipe will be designated by an "a," "b," "c" or "d" suffix, designated from the top down, and the intake pipes in general will be identified by reference numeral 60, without suffix. Each intake pipe 60 communicates with an individual combustion chamber of the engine 12 through the intake valve system. The intake manifold 58 extends from the cylinder head on the induction side of the engine 12, and terminates in a flange 62 that extends generally parallel to a sealing surface of the cylinder head 50 that engages the cylinder block 46.

An induction system 64 of the engine 12 supplies a fuel/air charge to the individual combustion chambers through the intake manifold 58. The induction system 64 includes an intake silencer 66 having a downwardly facing air inlet 68 which is disposed to the front of the power head 16 and on one side of the crankcase 48. The intake silencer 66 draws air into the engine 12 from the interior of the cowling 18 and silences the intake air charge.

A series of induction pipes 70 deliver the air flow from the intake silencer 66 to a plurality charge formers 72. The induction pipes 70 are positioned along one side of the cylinder head 46. Each induction pipe 70 services an individual charge former 72. The lengths of the induction pipes 70 desirably are tuned with the intake silencer 66 to minimize the noise produced by the induction system 64, as known in the art.

In the illustrated embodiment, the charge formers 72 are a plurality of vertically aligned carburetors. That is, the carburetors are positioned above one another, stacked in a direction generally parallel to the vertical axis. It should be understood, however, that although the present linkage system 14 is described in conjunction with a carbureted engine, certain facets the of invention may be employed in conjunction with other types of charge formers, such as fuel injectors or the like. For ease of description, each carburetor will be designated by an "a," "b," "c," or "d" suffix, identified from the top down, and the carburetors in general shall be designated reference numeral 72, without suffix.

Figure 2:
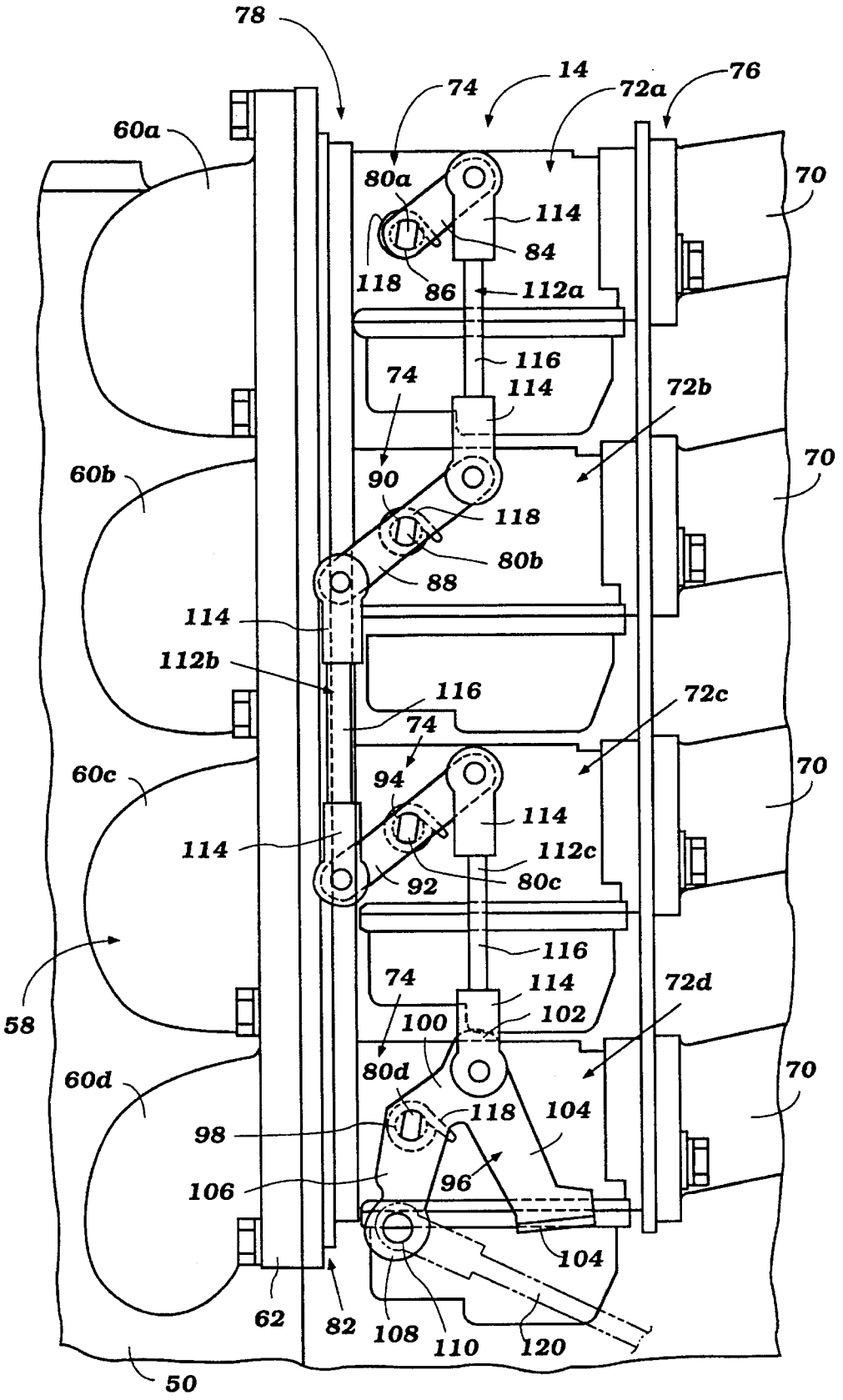
FIG. 2 is a side elevational view of a throttle mechanism for an engine of the outboard motor of FIG. 1.

With reference to FIG. 2, the carburetors 72 may be of any known type and construction. In the illustrated embodiment, each carburetor 72 includes a throttle body 74 which defines a cylindrical bore (not shown) between an inlet end 76 and an outlet end 78. A throttle shaft 80 passes transversely through the bore and supports a throttle valve. The throttle shaft 80 operates the throttle valve. Again, for ease of description, each throttle shaft will be designated by an "a," "b," "c," or "d" suffix, identified from the top down, and the throttle shafts in general shall be designated reference numeral 80, without suffix.

In the illustrated embodiment, the throttle valve desirable is a conventional butterfly-type valve; however, it is understood that certain aspects of the present invention can also be used with other types of throttle valves, such as, for example, sliding-type valves. Rotation of the throttle shaft 80 causes the valve to rotate to impede fluid flow through the throttle body 74 to varying degrees, as known in the art. At least one end of the throttle shaft 80 extends through the wall of the throttle body 74 to control the position of the valve within the throttle body bore.

As seen in FIG. 1, the carburetors 72 are attached to the intake manifold flange 62 by means that includes a common insulator assembly 82, such that each carburetor 72 delivers a charge to the individual intake pipes 60 of the cylinder head 50. A suitable insulator assembly 82 is disclosed in copending U.S. patent application, Ser. No. 08/302,184, filed Sep. 8, 1994, in the names of Sadato Yoshida, Hiroshi Nakai, Akihiko Hoshiba, and Yasuhiko Shibata, and assigned to the assignee hereof, which is hereby incorporated by reference.

The outboard drive 10 so far described is generally typical of prior outboard drive construction, with the exception of the incorporated material. However, in accordance with the present invention, an improved linkage system 14 is incorporated into the engine 12 to synchronize the operation of the charge formers 72 with minimal variation in the synchronization of the charge formers 72 due to thermal expansion of the components of the linkage 14.

It initially should be noted that the present linkage system 14 can be used to synchronize the operation of any of a variety of different types of operators of the charge former 72, such as, for example, the throttle valves, the choke valves and the like. In addition, it is contemplated that the present linkage system 14 can be readily adapted for use with a variety of different types of valves, such as, for example, butterfly-type valves, sliding valves, and the like, which are commonly used to regulate flow through the charge former 72 or through the induction system 64 of the engine 12. For purposes of illustration, however, the present linkage system 14 will now be described in connection with the operation of the plurality of throttle shafts 80 of the charge formers 72.

The linkage system 14 is formed by a series of throttle levers interconnected by a plurality linkage rods. Though the following describes the throttle linkage 14 in reference to its illustrated vertical orientation, it is understood that the present invention also is applicable with other arrangements of the charge formers. It is also understood that, although the present linkage system 14 is described as applied to a series of aligned throttle shafts (i.e., the throttle shafts 80 lie generally in a common plane and parallel to one another with a common vertical axis extending perpendicularly to each throttle shaft), the present invention also can be adapted for use with other arrangements of the throttle shafts 80 or similar operators of charge formers 72. The individual components of the illustrated linkage system 14 will now be described in detail with primary reference to FIG. 2.

A first throttle lever 84 is attached to the throttle shaft 80*a* of the upper carburetor 72*a*. An end of the first throttle lever 84 is fixed onto the throttle shaft 80*a* by inserting the throttle shaft 80*a* into an aperture 86 at the end of the lever 84. The first throttle lever 84 extends upward and towards the inlet end 76 of the carburetor 72*a*, at desirably about a 45° angle relative to the vertical axis.

A second throttle lever 88 is attached to the throttle shaft 80*b* of the second carburetor 72*b*. The second throttle lever 80*b* has a length about twice that of the first throttle lever 84, and defines an aperture 90 at its longitudinal center. The aperture 90 receives the throttle shaft 80*b* to fix together the second throttle shaft 80*b* and the second throttle lever 88. Rotations of the throttle lever 88 rotates the throttle shaft 80*b*. The second throttle lever 88 is positioned on the throttle shaft 80*b* so as to extend in a direction generally parallel to the first throttle lever 84.

A third throttle lever 92 is fixed onto the third throttle shaft 80*c* so as to extend generally parallel to the first and second throttle lever 84, 88. The third throttle lever 92 has a length generally equal to the length of the second throttle lever 88. An aperture 94 at the longitudinal center of the throttle lever 92 receives the third throttle shaft 80*c* to fix the lever 92 to the throttle shaft 80*c*.

A fourth throttle lever 96 is attached to the fourth throttle shaft 80*d*. The fourth throttle lever 96 includes a first aperture 98 which receives the fourth throttle shaft 80*d*. The fourth throttle lever 96 and throttle shaft 80*d* rotate together.

The fourth throttle lever 96 has an irregular shape with a first section 100 that extends from the first aperture 98 upward and towards the inlet side 76 of the fourth carburetor 72*d* in a direction generally parallel to the other throttle levers 84, 88, 92. The first section 100 terminates at a corner 102. A second section 104 extends from the corner 102 downward in a direction general perpendicular to the first section 100, and terminates at a tang 104. Opposite the first section 100, a third section 106 of the fourth throttle lever 96 extends from the first aperture 98 downward, towards the outlet end 78 of the fourth carburetor 72*d*. The third section 106 terminates at a lower end 108 which defines a second aperture 110.

Linkage rods 112 interconnect the ends of the throttle levers 84, 88, 92, 96 at points distal of the throttle shafts 80. In the illustrated embodiment, each linkage rod 112 includes a pair of end connectors 114 which are attached in a known manner to adjacent distal ends of corresponding throttle levers. A tie rod 116, having threaded ends, extends between the end connectors 114. Each threaded end of the tie rod 116 engages a correspondingly threaded receptacle of the end connectors 114. The threaded ends of the tie rod 116 desirably are reversed such that rotation of the tie rod 116 in one direction increases the length of the distance between end connectors 114, and rotation in the opposite direction decreases the length between end connectors 114. In this manner, the orientation of the attached throttle levers and their respective throttle shafts can be adjusted easily. For ease of description, each linkage rod will be designated by an "a," "b," or "c" suffix, identified from the top down, and the linkage rods in general shall be designated reference numeral 112, without suffix.

In the illustrated embodiment, a first linkage rod 112a of the type described above connects the distal end of the first throttle lever 84 with a distal end of the second throttle lever 88 on the inlet side 76 of the carburetors 72. The first linkage rod 112*a* extends between the first and second levers 84, 88 generally in the vertical direction.

A second linkage rod 112*b* connects the distal ends of the second and third throttle levers 88, 92 on the outlet side 78 of the carburetors 72. The second linkage rod 112*b* lies generally parallel to the first linkage rod 112*a*.

The throttle linkage 14 also includes a third linkage rod 112*c* that connects the distal end of the third lever 92 on the inlet side 76 of the carburetors 72 to the corner 102 of the fourth lever 96. The third linkage rod 112*c* lies generally collinear with the first linkage rod 112*a* and parallel to the second linkage rod 112*b*.

As seen in FIG. 2, a torsion spring 118 extends between each throttle body 74 and each throttle lever 84, 88, 92, 96. The springs 118 bias the throttle valves towards a closed position, as known in the art. Rotation of the throttle shaft 80 in a direction which opens the throttle valve, twists the torsion spring 118 to increase the spring force applied by the spring 118 on the throttle lever.

As seen in FIG. 2, a conventional bowden wire cable 120 connects to the second aperture 110 of the fourth throttle lever 96 at its lower end to operate the throttle linkage. The bowden wire cable 120 couples the throttle linkage 14 to a throttle control mechanism in a known manner. Actuation of the control mechanism operates the throttle linkage 14 to control the throttle valves of the carburetors 72.

In the illustrated embodiment, actuation of the control mechanism extends the bowden wire cable 120 to rotate the fourth throttle lever 96 in the clockwise direction. Clockwise rotation of the level 96 and thus the throttle shaft 80*d* opens the throttle valve.

The throttle linkage 14 communicates the rotation of the fourth throttle lever 96 to the other throttle shafts 80*a*, 80*b*, 80*c*. Specifically, in the illustrated embodiment, clockwise rotation of the fourth throttle lever 96 moves the third linkage rod 112*c* downward, causing the third throttle lever 92 to rotate clockwise by the same degree. The third throttle lever 92 moves the second linkage 112*b* upward in response, thereby causing the second throttle lever 88 to rotate clockwise by the same degree as the third and fourth throttle levers 92, 96. Clockwise rotation of the second throttle lever 88 in turn draws the first linkage rod 112*a* downward to rotate the first throttle linkage 84 in the clockwise direction. In this manner, the throttle linkage 14 communication the rotation of the fourth throttle shaft 80*d* to the balance of the throttle shafts so as to move the throttle valves in the same direction and to the same decree.

Retraction of the bowden wire cable 120 moves the throttle linkage 14 in a similar manner, but in the opposite direction. The throttle levers 84, 88, 92, 96 rotate in the counterclockwise. The first and third linkage rods 112*a*, 112*c* move upward and the second linkage rod 112*b* moves downward. The torsion springs 118 assist the movement of the throttle linkage 14 in this direction.

The above-described configuration of the linkage system 14 reduces the effects of thermal expansion within the linkage system 14 (specifically within the linkage rods 112) on the position of the throttle shafts 80. Such thermal expansion within the linkage rods 112 therefore effects the synchronization of the throttle valve less when the engine operates at an elevated temperature than in prior linkage designs.

The present linkage system 14 achieves this result by coupling the linkage rods 112 to the throttle shaft 80 in a manner in which thermal expansion in one linkage rod generally offsets thermal expansion in the other linkage rod. For instance, with reference to the second throttle shaft 80*b* illustrated in FIG. 2, the first linkage rod 112*a* and the second linkage rod 112*b* are connected to the second throttle shaft 80*b* in a manner in which thermal expansion of the first linkage rod 112*a* forces the second throttle shaft 80*b* to rotate in a direction which is generally opposite to a direction in which thermal expansion of the second linkage rod 112*b* forces the second throttle shaft 80*b* to rotate. Consequently, these resultant forces generally offset each other, both in magnitude and direction, and the resultant forces due to thermal expansion in the linkage rods 112 generally do not significantly effect the position of the throttle shafts 80.

Where the linkage system 14 contains an uneven number of linkage rods 112, as in the illustrated embodiment, the described coupling arrangement reduces the effect on the throttle shafts 80 of thermal expansion within the throttle linkage 14. For instance, with reference to FIG. 2, the upper throttle shaft 80*a* is less effected by thermal expansion in the linkage rods 112 because the second linkage rod 112*b* is placed on an opposite side of the throttle shafts 80 than the first and third linkage rods 112*a*, 112*b*, rather than aligning the linkage rods 112 as done in the prior art.

The linkage rods 112, having the same length, will all increase by generally the same amount $\Delta L$. The increased length $\Delta L$ of the second and third linkage rods 112*b*, 112*c*, however, will tend to offset each other. The increased length of the first linkage rod 112*a* thus moves the distal end of the first throttle lever 84 upward by an amount equal to the change in length $\Delta L$ of a first linkage rod 112*a*. The variance in position of the upper throttle valve from the balance of the throttle valves is reduced by two-thirds from that experienced with prior throttle linkages. In addition, the position of the other throttle valves are substantially unaffected by thermal expansion within the present linkage system 14.

With an even number of linkage rods 112, the effects of thermal expansion in the linkage rods 112 on the throttle increase in length of the linkage rods 112 on one side of the throttle shafts 80 tends to cancel the combined increase in length of the linkage rods 112 on the other side of the throttle shafts 80.

Although this invention has been described in terms of a certain preferred embodiment, other embodiments apparent to those of ordinary skill in the art are also within the scope of this invention. Accordingly, the scope of the invention is intended to be defined only by the claims which follow.

What is claimed is:

1. A linkage system between a plurality of charge formers in an engine to interconnect a plurality of operators of said charge formers, said linkage system comprising a plurality of linkage rods which interconnect adjacent operators, at least first and second linkage rods of said plurality of linkage rods being connected to a first operator of the plurality of operators in a manner in which thermal expansion of said first linkage rod forces the first operator in a direction generally opposite to a direction in which thermal expansion of said second linkage rod forces the first operator.

2. The linkage system of claim 1, wherein said first and second linkage rods are connected to said first operator in a manner in which a first force produced by thermal expansion of said first linkage rod and acting on said first operator is generally equal in magnitude to a second force produced by thermal expansion of said second linkage rod and acting on said first operator.

3. The linkage system of claim 2 additionally comprising a plurality of levers, each lever being attached to an individual operator.

4. The linkage system of claim 3, wherein a first lever of said plurality of levers connects to said first operator, and said first and second linkage rods connect to said first lever.

5. The linkage system of claim 1, wherein the operators are control shafts for flow adjustment devices of said charge formers.

6. A linkage system between a plurality of charge formers in an engine to interconnect a plurality of operators of such charge formers, said linkage system comprising a plurality of levers, each lever being attached to an individual operator, and a plurality linkage rods which interconnect adjacent levers, at least first and second linkage rods of said plurality of linkage rods being connected to a first lever of said plurality of levers so as to symmetrically position said first and second linkage rods on said first lever about said first operator.

7. A linkage system between a plurality of charge formers which interconnect a plurality of operators of said charge formers, said linkage system comprising a plurality of linkage rods which interconnect adjacent operators, at least first and second linkage rods of said plurality of linkage rods being connected to a first operator of said plurality of operators, said first and second linkage rods being positioned so as to lie generally parallel to each other on opposite sides of said first operator.

8. A linkage system between a plurality of throttle devices in an engine to interconnect throttle shafts which operate throttle valves of said throttle devices, said linkage system comprising a plurality of levers, each lever being attached to an individual throttle shaft with at least one lever of said plurality of levers being connected to the corresponding throttle shaft at a position generally located at the center of said lever in a longitudinal direction, and a plurality of linkage rods interconnecting adjacent pairings of said levers, at least first and second linkage rods being connected to a first lever of said plurality of levers.

9. The linkage system claim 8, wherein at least one lever of said plurality of levers has a length at least twice that of another lever of said plurality of levers.

10. The linkage system of claim 8, wherein at least one lever is symmetrically positioned on an individual throttle shaft relative to an axis of said throttle shaft.

11. A linkage system between a plurality of throttle devices in an engine to interconnect throttle shafts which operate throttle valves of said throttle devices, the throttle shafts lying generally in a common plane parallel to one another with a common axis extending perpendicularly through each throttle shaft, said linkage system comprising a plurality of levers, each lever being attached to an individual throttle shaft, and a plurality of linkage rods interconnecting adjacent pairings of said levers, at least said first and second linkage rods being connected to a first lever of said plurality of levers and being positioned on opposite sides of said common axis.

12. The linkage system of claim 11, wherein said first and second linkage rods extend in a direction generally parallel to said common axis.

13. The linkage system of claim 11, wherein said first and second linkage rods are connected to the ends of said first lever, and an individual throttle shaft is connected to said first lever at a point about equally distanced from said first and second linkage rods.

14. The linkage system of claim 13, wherein said second linkage rod connects to an end of second lever of said plurality of levers and a third linkage rod connects to an opposite end of said second lever, said first and third linkage rods lying to a side of said common axis opposite that to which said second linkage rod lies.

15. The linkage system of claim 11, wherein said linkage rods are arranged relative to one another so that adjacent linkage rods alternate to either side of said common axis.

16. The linkage system of claim 11, wherein said linkage rods are positioned symmetrically about said common axis.

17. The linkage of claim 11, wherein said linkage rods on one side of said common axis are distanced from said common axis by an amount which is generally equal to an amount by which said linkage rods on the opposite side of said common axis are distanced from said common axis.

18. A linkage system between a plurality of charge formers in an engine which interconnects a plurality of operators of the charge formers, each operator being movable relative to an operator axis, said linkage system comprising a plurality of linkage rods which interconnect adjacent operators, at least first and second linkage rods of said plurality of linkage rods being coupled to a first operator of said plurality of operators, said first linkage rod being coupled on a side of the operator axis of said first operator that is opposite of the side on which said second linkage rod is coupled to said first operator.

19. The linkage system of claim 18, wherein said operators of said charge formers rotate about said operator axis and said linkage system additionally comprises a plurality of levers, each lever being attached to an individual operator, said first and second linkage rods being attached to a first lever connected to said first operator.

20. The linkage system of claim 19, wherein said first and second linkage rods are attached to the first lever at positions which are symmetric relative to said operator axis of said first operator.

* * * * *